US009605569B1

(12) United States Patent
Lekowicz

(10) Patent No.: US 9,605,569 B1
(45) Date of Patent: Mar. 28, 2017

(54) CLOSED-LOOP OIL-TRANSFER SYSTEM FOR A VEHICLE

(71) Applicant: Raymond Lekowicz, Wilmington, CA (US)

(72) Inventor: Raymond Lekowicz, Wilmington, CA (US)

( * ) Notice: Subject to any disclaimer, the term of this patent is extended or adjusted under 35 U.S.C. 154(b) by 0 days.

(21) Appl. No.: 14/215,802

(22) Filed: Mar. 17, 2014

Related U.S. Application Data

(60) Provisional application No. 61/791,366, filed on Mar. 15, 2013.

(51) Int. Cl.
*F01M 1/04* (2006.01)
*F01M 7/00* (2006.01)

(52) U.S. Cl.
CPC ..... *F01M 7/00* (2013.01)

(58) Field of Classification Search
CPC ..... F01M 11/0458; F01M 11/03; F01M 11/0004; F01M 2011/0466; F01M 11/06
USPC ..... 123/196 CP, 196 R
See application file for complete search history.

(56) References Cited

U.S. PATENT DOCUMENTS 3,447,636 A * 6/1969 Bonfilio ..... F01M 11/0458 123/196 R
4,454,031 A * 6/1984 Schier ..... F15B 1/26 210/120
4,454,032 A * 6/1984 Dupont ..... B01D 29/05 210/143
4,674,456 A 6/1987 Merritt
4,989,560 A * 2/1991 Rasdal ..... F01M 11/04 123/196 S
5,092,429 A * 3/1992 Linares ..... F01M 11/0458 123/196 S
5,390,762 A * 2/1995 Nelson ..... F01M 11/0458 123/196 S
5,881,688 A * 3/1999 Graham ..... 123/73 AD
6,082,322 A * 7/2000 Graham ..... F01M 11/0458 123/196 S
6,213,080 B1 * 4/2001 Marsh ..... F01M 11/0458 123/196 R
7,686,136 B2 * 3/2010 Evans ..... F01M 11/04 184/1.5
2003/0037993 A1 * 2/2003 Hatch ..... F01M 11/0458 184/6.5
2003/0056824 A1 * 3/2003 Harvey ..... F02M 37/0047 137/265
2003/0188576 A1 * 10/2003 Park ..... F01M 11/0458 73/307
2006/0096809 A1 * 5/2006 Evans ..... F01M 11/04 184/6.5

(Continued)

*Primary Examiner* — Long T Tran
(74) *Attorney, Agent, or Firm* — Kenneth L Tolar

(57) ABSTRACT

A closed-loop oil transfer system for a commercial vehicle includes a refill reservoir having a sufficient amount of fresh, unused engine oil to completely replace the existing oil within the vehicle engine, and a waste reservoir dimensioned to accommodate the entire volume of existing engine oil. A bidirectional pump is in fluid communication with both the waste reservoir and refill reservoir via a series of pipes and valves. A control switch allows an operator to easily reverse the direction of the pump to transfer oil from the engine to the waste reservoir, or to transfer the fresh oil from the fill reservoir to the engine.

5 Claims, 2 Drawing Sheets

(56) References Cited

U.S. PATENT DOCUMENTS

2009/0126700 A1* 5/2009 Weller ..... F01M 9/02
123/518

* cited by examiner

CLOSED-LOOP OIL-TRANSFER SYSTEM FOR A VEHICLE

CROSS REFERENCE TO RELATED APPLICATIONS

This application is entitled to the benefit of provisional patent application No. 61/791,366 filed on Mar. 15, 2013, the specification of which is incorporated herein by reference.

BACKGROUND OF THE INVENTION

The present invention relates to a system that allows an operator to quickly and easily replenish or replace engine oil within a vehicle.

DESCRIPTION OF THE PRIOR ART

The engine oil in commercial vehicles, such as semi-trailer trucks or 18-wheelers, must be replaced routinely, i.e., approximately every 10,000 miles. Typically, in order to replace the oil, the operator must drive the vehicle to a maintenance facility, which is not always available or accessible near a given route. Regardless, if an oil replacement is overdue during a given journey, the driver must discontinue further travel until the oil has been properly replaced. Discontinuing the journey to search for a suitable maintenance facility can significantly delay the delivery of time-sensitive cargo, which is extremely costly for either the carrier or the recipient. Electing to defer the oil replacement until reaching the destination can cause irreparable damage to the vehicle's engine.

Accordingly, there is currently a need for a device that allows a commercial-vehicle driver to quickly and easily replace or replenish engine oil without seeking a maintenance facility. A review of the prior art reveals at least one oil replenishment system for a vehicle. For example, U.S. Pat. No. 4,674,456 issued to Merritt discloses a device for periodically replacing a portion of the crankcase oil in a vehicle combustion engine. The device employs a controller to remove a portion of used oil at given intervals according to suggested operating guidelines. For example, if the oil should be changed every 3000 miles, one-fifth of the entire oil will be replenished at each 600-mile interval.

Although Merritt automatically replaces used oil with fresh oil, it only does so incrementally, which assures that spent oil is always mixed with fresh oil. Furthermore, Merritt discloses no means for conveniently replacing an oil filter without spilling spent oil onto a surrounding area. The present invention overcomes the disadvantages of the prior art by providing an onboard system that allows a vehicle operator to easily and completely drain spent oil from both the engine and the oil-filter housing, and subsequently transfer fresh oil thereto.

SUMMARY OF THE INVENTION

The present invention relates to a closed-loop oil transfer system for a commercial vehicle comprising a pair of oil reservoirs conveniently mounted on the rear of the vehicle's passenger cab. A refill reservoir includes a sufficient amount of fresh, unused engine oil to completely replace the existing oil within the vehicle engine, while a waste reservoir is dimensioned to accommodate the entire volume of existing engine oil. A bidirectional pump is in fluid communication with both the waste reservoir and refill reservoir via a series of pipes and valves. A control switch allows an operator to easily reverse the direction of the pump to remove used oil from the engine and oil-filter housing, or to transfer fresh oil thereto from the refill reservoir.

Accordingly, to replace the engine oil, the vehicle operator simply stops the vehicle in a convenient location along a current route. The pump is activated to transfer oil from the engine to the waste reservoir. Once all used oil has been removed from the engine and oil filter, the pump direction is reversed to transfer the fresh oil from the refill reservoir to the engine.

It is therefore an object of the present invention to provide an oil-transfer system for a commercial vehicle that allows an operator to quickly and easily replace engine oil.

It is another object of the present invention to provide an oil-transfer system for a commercial vehicle that eliminates the burdensome and time-consuming task of seeking a maintenance facility when replacing engine oil.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
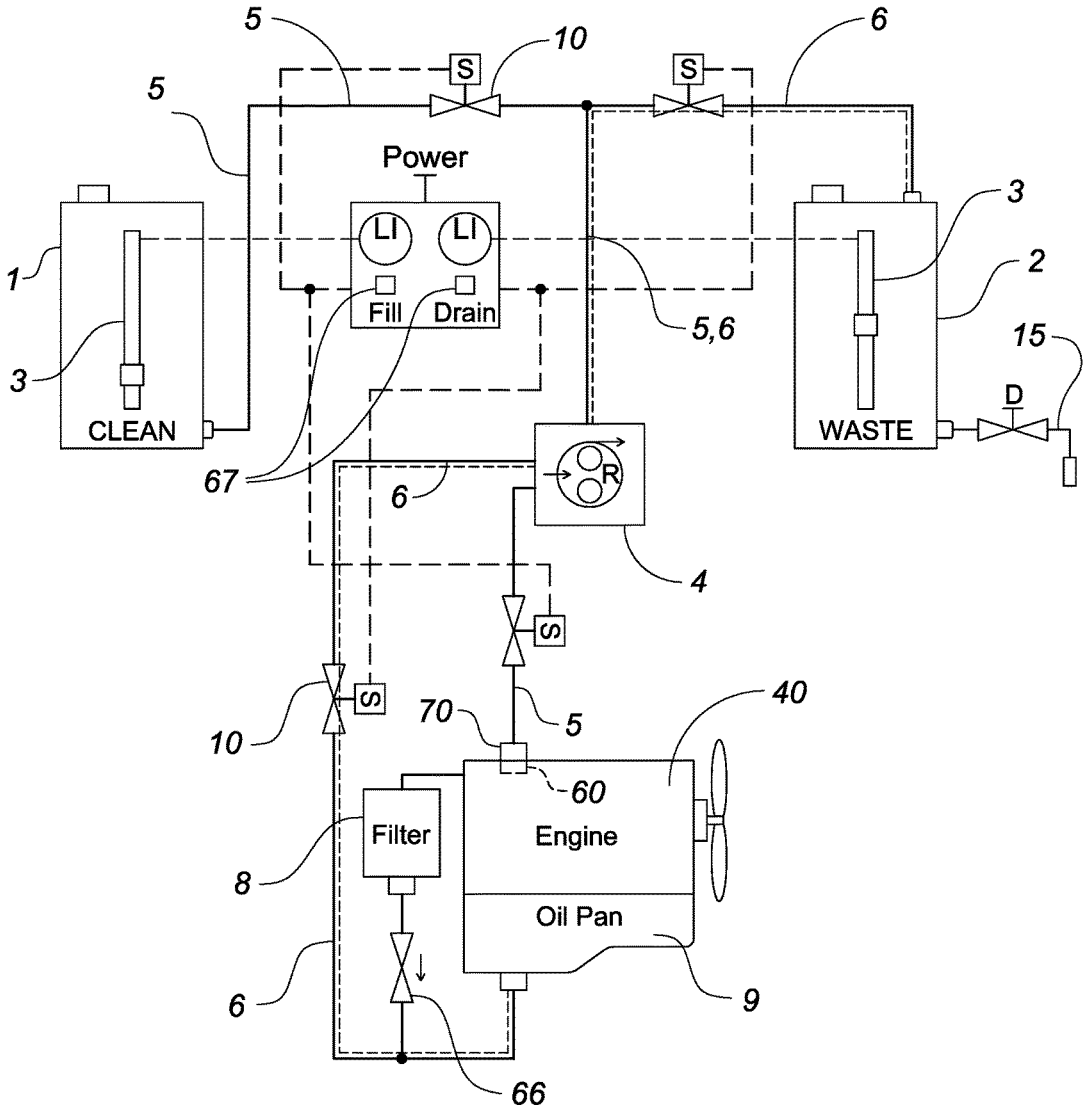
FIG. 1 is a schematic of the major components of the oil-transfer system according to the present invention.
Figure 2:
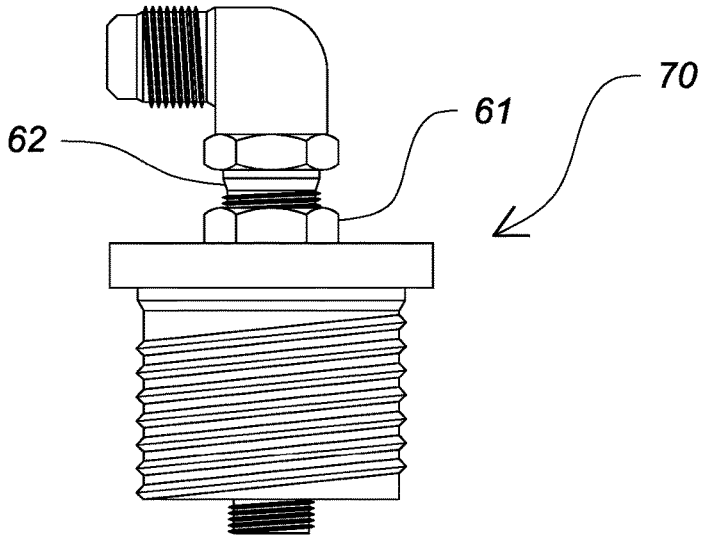
FIG. 2 is an isolated view of the cap for mating with the engine's oil-cap port.

The present invention relates to a closed-loop oil transfer system for a commercial vehicle comprising a pair of oil reservoirs conveniently mounted on the rear of the vehicle's passenger cab. A refill reservoir 1 includes a sufficient amount of fresh, unused engine oil to completely replace the existing, spent oil within the vehicle engine, while a waste reservoir 2 is dimensioned to accommodate the entire volume of existing engine oil. A designated electronic float gauge 3 informs an operator of the relative contents of each reservoir. The waste reservoir includes a dump fitting 15 that allows the operator to conveniently discard the used oil into an external waste-disposal receptacle.

A bidirectional pump 4 is in fluid communication with both the waste reservoir 2 and fill reservoir 1 via a series of pipes and valves 10. A first series of pipes define a refill flow path 5 that interconnects the refill reservoir, pump and vehicle-engine crankcase oil reservoir 40. The refill flow path terminates at the oil-cap port 60 on top of the engine crankcase oil reservoir 40. The conventional oil cap is replaced with a uniquely designed cap 70 that is configured to mate with the port. The cap further includes a central, threaded bore 61 to which a threaded pipe 62 fitting is connected to establish fluid communication between the refill path and the oil reservoir 40.

A second series of pipes define a drain path 6 that interconnects the engine's oil filter housing 8 and oil pan 9 to the pump 4 and waste reservoir 2. Preferably, the conduit connected to the oil-filter housing includes a check valve 66 that prevents oil from exiting the housing under normal operation. However, when performing an oil change, an operator can simultaneously drain both the engine and filter housing. Therefore, the operator can quickly and easily replace the filter without spilling used oil along a roadway or any other public location. Draining the filter housing also minimizes the amount of spent oil that will contaminate fresh oil when a change is performed.

One or more control switches 67 allow an operator to easily reverse the direction of the pump 4 to transfer oil along either the refill path 5 or drain path 6. A predetermined combination of valves are either manually or automatically opened or closed to isolate the drain and refill paths to prevent cross contamination.

Accordingly, to replace the engine oil, the operator simply stops the vehicle in a convenient location along a current route. The proper combination of valves are manually opened and closed in order to open the drain path and to close the refill path, if the system is equipped with manual valves. If solenoid or other electronic valves are installed, a drain switch is activated, which opens the drain path. In either case, the pump is activated, either with a designated switch in the manual version or automatically with the electronic version, to transfer oil from the engine and filter housing to the waste reservoir. Once all used oil has been removed from the engine and oil-filter housing, the proper combination of valves are manually or automatically opened and closed in order to close the drain path and open the refill path. The pump direction is reversed (either automatically or with a "fill" switch") to transfer the fresh oil from the refill reservoir to the engine.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A closed-loop oil transfer system in combination with a vehicle having an engine crankcase oil reservoir, a crankcase oil pan and an engine oil-filter housing comprising:

an oil refill reservoir mounted on said vehicle having an amount of fresh, unused engine oil to completely replace an entire quantity of existing oil within said engine crankcase oil reservoir, said crankcase oil pan and said engine oil-filter housing;

a waste reservoir mounted on said vehicle dimensioned to accommodate the entire quantity of existing oil within said engine crankcase oil reservoir, said crankcase oil pan and said engine oil-filter housing;

a bidirectional pump in select fluid communication with said engine oil pan, said engine oil filter and said waste reservoir;

a first control switch that instructs said bidirectional pump to transfer oil in a first direction to deliver fluid from said engine oil pan and said engine oil-filter housing to said waste reservoir;

means for delivering oil from said refill reservoir to said engine crankcase oil reservoir.

2. The closed-loop oil transfer system according to claim 1 wherein said means for delivering oil from said refill reservoir to said engine crankcase oil reservoir comprises:

said pump in select fluid communication with said refill reservoir and said engine crankcase oil reservoir;

a second control switch that instructs said pump to transfer oil in a second direction to deliver fluid from said refill reservoir to said engine crankcase oil reservoir.

3. The closed-loop oil transfer system according to claim 1 further comprising an electronic float gauge within said waste reservoir and said refill reservoir for informing a user of a level therein.

4. The closed-loop oil transfer system according to claim 1 further comprising:

an oil-cap port on a top surface of the engine crankcase oil reservoir;

a cap received within said port, said cap including a central, threaded bore;

a pipe fitting threadedly engaging said bore and in fluid communication with said bidirectional pump.

5. The closed-loop oil transfer system according to claim 1 wherein said waste reservoir includes a dump fitting that allows the operator to discard the existing oil into an external waste-disposal receptacle.

* * * * *